United States Patent [19]

Takahashi et al.

[11] Patent Number: 4,669,398

[45] Date of Patent: Jun. 2, 1987

[54] PULVERIZED FUEL FIRING APPARATUS

[75] Inventors: Yasuro Takahashi; Yukihisa Fujima; Kimishiro Tokuda, all of Nagasaki, Japan

[73] Assignee: Mitsubishi Jukogyo Kabushiki Kaisha, Japan

[21] Appl. No.: 777,878

[22] Filed: Sep. 20, 1985

Related U.S. Application Data

[63] Continuation of Ser. No. 529,934, Sep. 7, 1983, abandoned, which is a continuation of Ser. No. 253,074, Apr. 10, 1981, abandoned.

[30] Foreign Application Priority Data

| | | | |
|---|---|---|---|
| Apr. 22, 1980 | [JP] | Japan | 55-53140 |
| Jul. 2, 1980 | [JP] | Japan | 55-90406 |
| Jul. 22, 1980 | [JP] | Japan | 55-100235 |
| Jul. 22, 1980 | [JP] | Japan | 55-100236 |

[51] Int. Cl.[4] ..... F23D 1/06

[52] U.S. Cl. ..... 110/347; 431/10; 431/12; 431/351; 431/178; 110/263; 110/265

[58] Field of Search ..... 431/10, 12, 278, 285, 431/351, 174, 178, 171; 110/263, 264, 265, 347

[56] References Cited

U.S. PATENT DOCUMENTS

| | | | |
|---|---|---|---|
| 3,890,084 | 6/1975 | Voorheis et al. | 431/10 |
| 3,976,420 | 8/1976 | Takahashi et al. | 431/10 |
| 4,095,928 | 6/1978 | Jones et al. | 431/8 |
| 4,150,631 | 4/1979 | Frey et al. | 110/186 |
| 4,270,895 | 6/1981 | Vatsky | 110/264 X |
| 4,294,178 | 10/1981 | Borro et al. | 110/347 |

*Primary Examiner*—Samuel Scott
*Assistant Examiner*—H. A. Odar
*Attorney, Agent, or Firm*—Toren, McGeady & Associates

[57] ABSTRACT

A pulverized fuel firing apparatus comprises a first pulverized fuel injection compartment so constructed that the combined amount of primary air and secondary air to be consumed is less than the theoretical amount of air required for the combustion of the pulverized fuel to be fed as mixed with the primary air to a furnace, a second pulverized fuel injection compartment so constructed that the combined primary and secondary air amount is substantially equal to the theoretical air for the pulverized fuel to be fed together with the primary air, and a supplementary air compartment for injecting supplementary air into the furnace. The three compartments are arranged close to one another and control the NOx production upon combustion of the pulverized fuel.

6 Claims, 10 Drawing Figures

FIG. 8
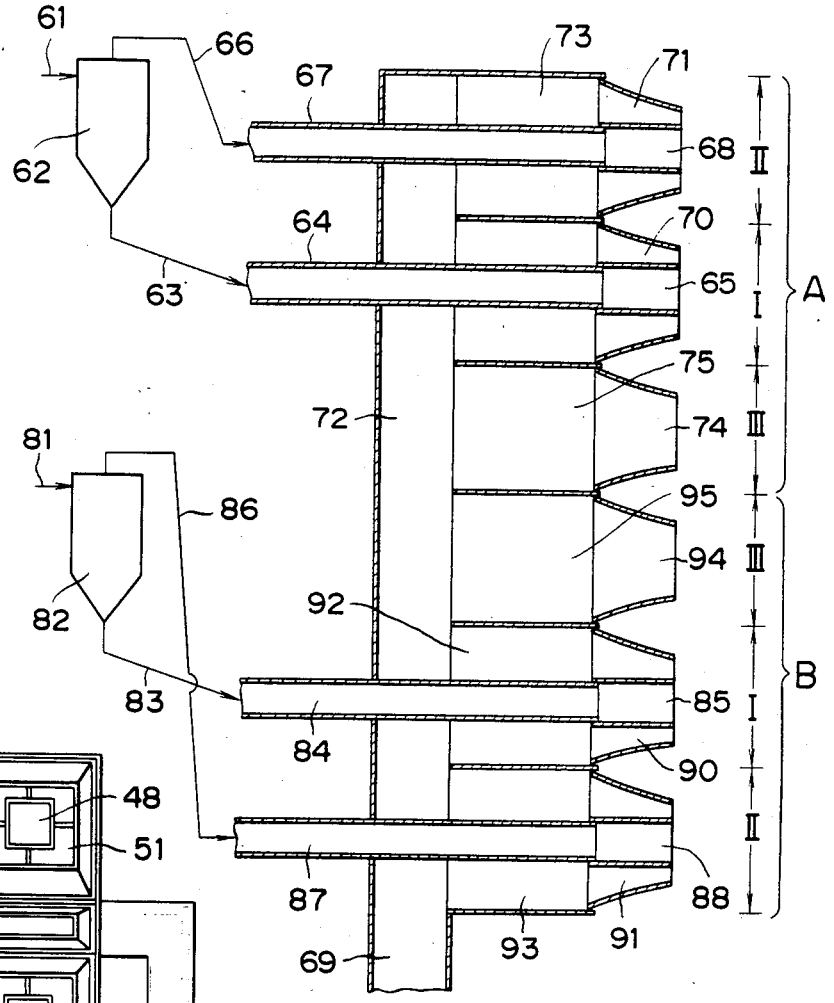
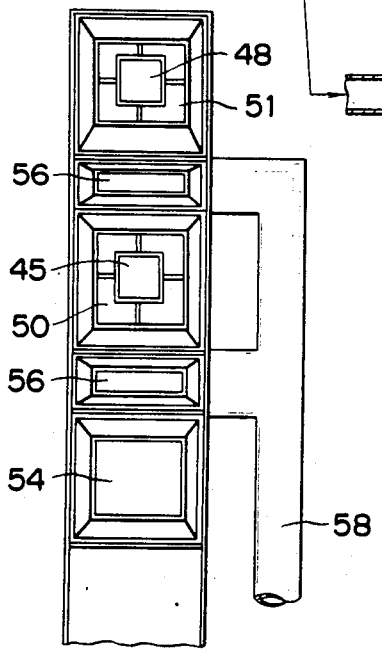
FIG. 7

PULVERIZED FUEL FIRING APPARATUS

This application is a continuation of application Ser. No. 529,934 filed Sept. 7, 1983 and now abandoned which is a continuation of application Ser. No. 253,074 filed Apr. 10, 1981 and now abandoned.

This invention relates to a pulverized fuel firing apparatus capable of controlling the production of nitrogen oxides upon combustion of pulverized fuel. More particularly, the invention concerns a pulverized fuel firing apparatus which comprises a first pulverized fuel injection compartment so constructed that the combined amount of primary air and secondary air to be consumed is less than the theoretical amount of air required for the combustion of the pulverized fuel to be fed as mixed with the primary air to a furnance, a second pulverized fuel injection compartment so constructed that the combined primary and secondary air amount is substantially equal to the theoretical air for the fuel to be fed together with the primary air, and a supplementary air compartment for injecting supplementary air into the furnace, the three compartments being arranged close to one another.

A conventional pulverized fuel firing apparatus which uses pulverized coal as fuel will be described below with reference to FIGS. 1 and 2.

Coal from a storage bunker 1 is transferred to a pulverizer 2, where it is ground to the fineness of several tens of microns. The pulverized coal is carried by primary air from a primary air fan 3, as a primary air-pulverized coal mixture, to a passageway 5 via line 4. Past the passageway 5, the primary air-pulverized coal mixture is injected into a furnace by a pulverized coal injection nozzle 6.

Air, needed for complete combustion, is supplied by a secondary air fan 7 through line 8 to a secondary air passageway 9. The secondary air is thence led through the passageway 9 and introduced into the furnace by a secondary air injection nozzle 10.

Injected into the furnace, the fine particles of the pulverized coal are exposed to the radiant heat of the flames there and begin to be heated. As the temperature rises to the range of 300°–400° C., the coal begins to undergo thermal decomposition, releasing volatile matter. At this stage, most of the nitrogen compounds also escape from the fine coal particles.

The volatile matter thus released mixes with the primary air and begins to burn as soon as the mixture reaches a proper temperature. Also, the released nitrogen compounds react with the primary air and form nitrogen oxides (NOx).

The total amount of the NOx to be formed in this way depends largely on the concentration of oxygen in the field of reaction, and it decreases as the oxygen concentration drops. This means that the greater the amount of primary air that is consumed by the volatile matter in the pulverized coal, or the smaller the amount of the primary air as compared with the theoretical amount of air required for the combustion of the volatile matter, the less the NOx production in the volatile matter combustion zone will be.

Following the burning of the volatile matter in the first zone, the combustion of the solid matter (char) freed from the volatiles takes place. In the latter process the oxygen spread over the char surface reacts with carbon that is the principal char constituent to form reducing carbon monoxide. At the same time, NOx are formed on the char surface by the oxidation of nitrogen compounds left in the char. Thus, if the amount of primary air is chosen from the range above the theoretical amount of air required for the combustion of the volatile matter and below the theoretical air for coal so as to retard the diffusion of secondary air through the flames and effect the combustion of char also with primary air, then the production of such a reducing gas component as carbon monoxide will grow in proportion to the increase in the amount of primary air.

The reducing gas so formed has an action to reduce NOx, and therefore it reduces the NOx produced in the char combustion zone as well as in the volatile matter zone. In this manner the NOx proportion will decrease as the primary air increases.

To sum up, the relation between the primary air and NOx is such that, as graphically represented in FIG. 3, the smaller the amount of primary air within the region where the amount is below the point a that represents the theoretical air for the volatile matter, the lower the NOx production; and the larger the amount of air within the region where the amount of primary air is above the point a and below the point b that represents the theoretical air for the coal, the lower the NOx production.

With the conventional combustion equipment the amount of primary air is chosen from the vicinity of the point a where the cooncomitant NOx production is at a maximum, because this air/pulverized coal concentration is generally suitable for carrying the pulverized coal into the furnace by an air blast. Since insufficient primary air can cause some trouble in the operation of the pulverizer 2, the amount of primary air cannot be decreased appreciably below the point a. If the amount is chosen close to the point b, the lean mixture will make stable ignition and combustion difficult.

The present invention has for its principal object the provision of an apparatus for firing pulverized fuel with low NOx emissions. In accordance with the invention, an apparatus is provided which is characterized by a first pulverized fuel injection compartment in which the combined amount of primary air and secondary air to be consumed is less than the theoretical amount of air required for the combustion of the pulverized fuel to be fed as mixed with the primary air to a furnace, a second pulverized fuel injection compartment in which the combined primary and secondary air amount is substantially equal to (or, preferably, somewhat less than) the theoretical air for the fuel to be fed as mixed with the primary air, and a supplementary air compartment for injecting supplementary air into the furnace, the three compartments being arranged close to one another. The gaseous mixtures of primary air and pulverized fuel injected by the first and second pulverized fuel injection compartments of the apparatus are mixed in such proportions as to reduce the NOx production. Moreover, the primary air-pulverized fuel mixture from the second pulverized fuel injection compartment, which alone can hardly be ignited stably, is allowed to coexist with the flame of the readily ignitable mixture from the first pulverized fuel injection compartment to ensure adequate ignition and combustion. Thus, an apparatus for firing pulverized fuel with stable ignition and low NOx production is provided.

Secondly, the invention is characterized in that additional compartments for issuing an inert fluid are disposed, one for each, in spaces provided between the three compartments. The gaseous mixtures of primary air and pulverized fuel are thus kept from interfering with each other by a curtain of the inert fluid from one of the inert fluid injection compartments, and the production of NOx out of the jets from the first and second pulverized fuel injection compartments can be minimized. Also, the primary air-pulverized fuel mixture from the first pulverized fuel injection compartment and the supplementary air from the supplementary air compartment are prevented from interfering with each other by another curtain of the inert fluid from another compartment. This permits the primary air-pulverized fuel mixture to burn without any change in the mixing ratio, thus avoiding any increase in the NOx production.

Thirdly, the invention is characterized in that the three compartments combinedly constitute a pulverized fuel burner, and at least two such burners are arranged adjacent to each other so that either of which is the mirror image of the other and their compartments are located symmetrically with respect to the boundary between the burners as the base line of symmetry. In this embodiment the compartments for the same functions of the burners are disposed immediately adjacent to each other, and the mutual interference, if any, will be of the jets of the same mixture or air. Hence there is no change in the mixing ratio of air and pulverized fuel, and reduction in NOx production is attained because combustion is always effected in an optimum state.

Fourthly, the invention is characterized in that the three compartments combinedly constitute a pulverized fuel burners, at least two such burners are arranged together, and an inert fluid nozzle for issuing an inert fluid is disposed between the burners. Thus, the jets of fuel mixture or air from the compartments of the first and second pulverized fuel burners are kept off from interfering with each other by a curtain of the inert fluid, with the consequence that any variation in the mixing ratio of the mixture is avoided and any increase in the NOx production is prevented.

While the embodiments of the invention to be described below use pulverized coal as fuel, it will be obvious to those skilled in the art that the invention may be equally practiced with other pulverized fuels.

The invention will be better understood from the following detailed description when taken in connection with the accompanying drawings, in which:

FIG. 7 is a front view taken on the line VII—VII of FIG. 6;

FIG. 8 is a partly sectional schematic view of a third embodiment of the invention;

Figure 4:
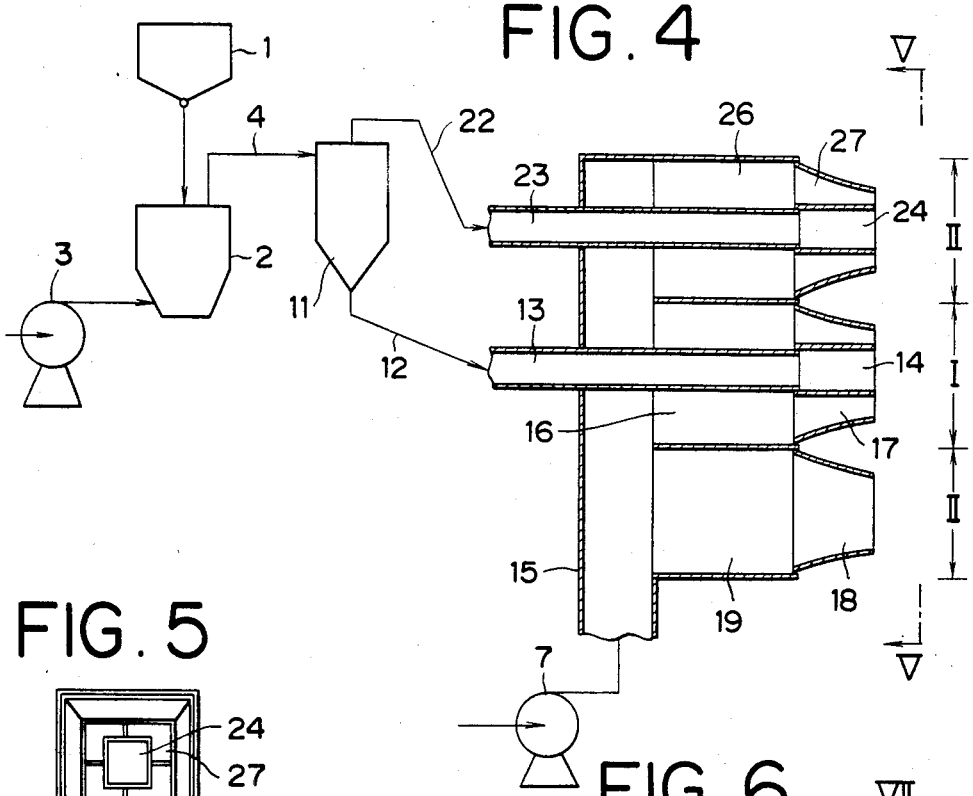
FIG. 4 is a schematic view, partly in section, of a first embodiment of the invention.
Figure 5:
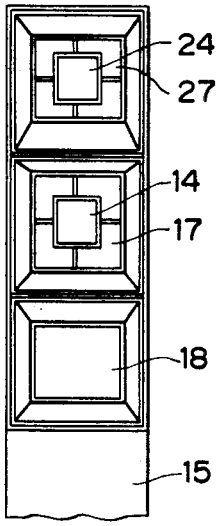
FIG. 5 is a front view taken on the line V—V of FIG. 4.

FIRST EMBODIMENT (Refer to FIGS. 4 and 5)

The downstream end of a pulverized coal line 4 is connected to a pulverized coal distributor 11, and an outlet of the distributor for delivering the fuel mixture containing a large proportion of pulverized coal is communicated through line 12 with a passageway 13 for the mixture of primary air and pulverized coal. At the downstream end of the passageway 13 is installed a nozzle 14 for pulverized coal injection. Another outlet of the distributor 11 for giving off the fuel mixture with a less proportion of pulverized coal is communicated through line 22 with a primary air-pulverized coal mixture passageway 23, which in turn carries at its downstream end a pulverized coal injection nozzle 24. A secondary air fan 7 connects with a secondary air pipe 15, which then connects with secondary air passageways 16, 26 surrounding the primary air-pulverized coal mixture passageways 13, 23 and holding at the downstream ends secondary air injection nozzles 17, 27, respectively. The pipe 15 also communicates with a supplementary air passageway 19, which terminates with a supplementary air nozzle 18.

The pulverized coal injection nozzle 14, primary air-pulverized coal mixture passageway 13, secondary air passageway 16, and secondary air injection nozzle 17 are combined to form a first pulverized fuel injection compartment I. Similarly, the pulverized coal injection nozzle 24, primary air-pulverized coal mixture passageway 23, secondary air passageway 26, and secondary air injection nozzle 27 combinedly form a second pulverized fuel injection compartment II. Further, the supplementary air passageway 19 and injection nozzle 18 jointly constitute a supplementary air compartment III. In order to arrange these three compartments close to one another, the second compartment II is located immediately over the top of the first compartment I and the supplementary air compartment III, immediately under the bottom of the first compartment.

Figure 1:
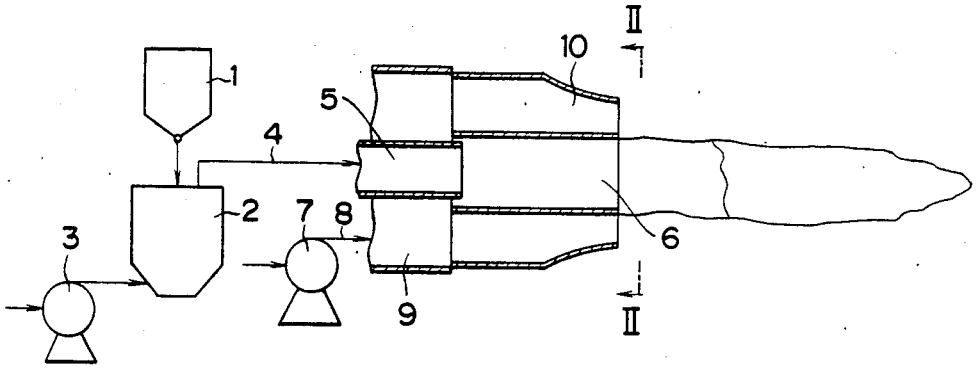
FIG. 1 is a schematic view of a conventional pulverized fuel firing apparatus using pulverized coal as fuel, partly sectioned to show the interior construction.
Figure 2:
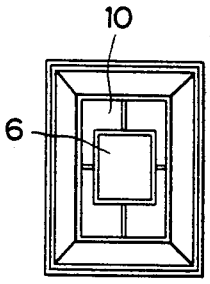
FIG. 2 is a front view taken on the line II—II of FIG. 1.
Figure 3:
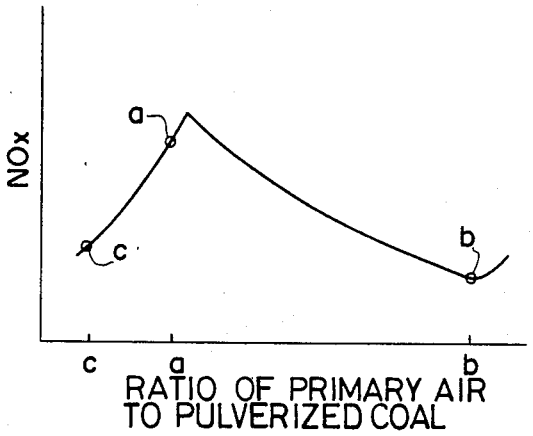
FIG. 3 is a graph showing the proportions of NOx formed at different primary air-pulverized coal ratios.

A primary air-pulverized coal mixture, with an air concentration in the vicinity of the point a in FIG. 3, is supplied from a coal pulverizer 2 through line 4 to the pulverized coal distributor 11, where it is divided by suitable means into two streams of gaseous mixtures differing in concentration, i.e., close to the points c and b, respectively, in FIG. 3.

The gaseous mixture with a concentration approximate to that of point c is led through the primary air-pulverized coal mixture passageway 13 and is injected by the pulverized coal injection nozzle 14 into the furnace. Meanwhile, secondary air is supplied by the secondary air fan 7 through the secondary air pipe 15, and part of it is conducted into the secondary air passageway 16 and injected by the secondary air injection nozzle 17 into the furnace.

On the other hand, the gaseous mixture with a concentration approximate to that of point b passes through the primary air-pulverized coal mixture passageway 23 and is injected by the pulverized coal injection nozzle 24 into the furnace, and part of the secondary air is led through the secondary air pipe 15 and passageway 26 and is injected by the secondary air injection nozzle 27 into the furnace.

The remainder of the secondary air is led through the supplementary air passageway 19 and issued by the supplementary air nozzle 18 into the furnace.

Thus, the primary air-pulverized coal mixture close to the concentration c and the secondary air from the first compartment I mix and burn together in the furnace, producing NOx in the combined concentration indicated at c in FIG. 3. Likewise, the primary air-pulverized coal mixture close to the concentration b and secondary air from the second compartment II mix and burn in the furnace to form NOx in the total concentration indicated at b in FIG. 3.

These NOx values are much lower than the value (as indicated at the point a in FIG. 3) given by the conventional pulverized coal firing apparatus that directly burns the pulverized coal with the concentration a.

The primary air-pulverized coal mixture close to the concentration b, which can itself hardly maintain stable ignition, will attain satisfactory ignition and combustion in the presence of the flame of the readily ignitable mixture having the concentration c.

In this way a pulverized coal firing apparatus capable of stable ignition with low NOx production is obtained.

Figure 6:
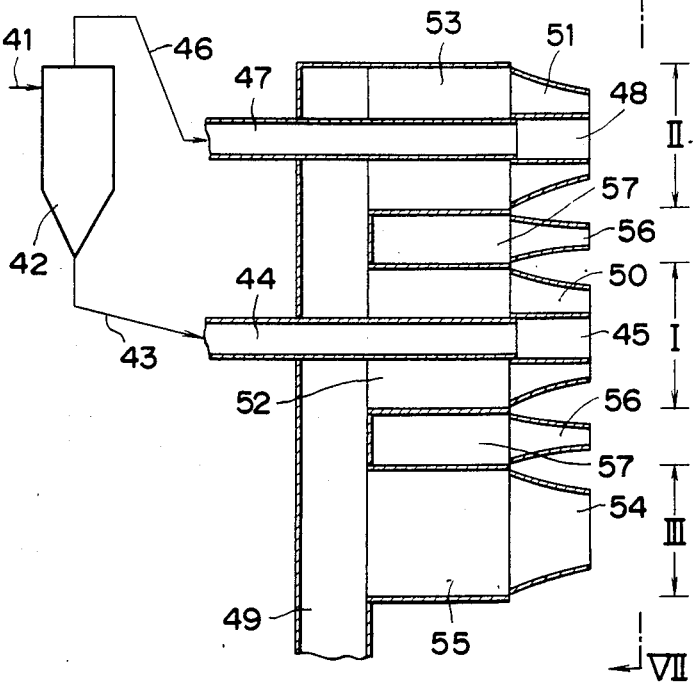
FIG. 6 is a partly sectional schematic view of a second embodiment of the invention.

SECOND EMBODIMENT (Refer to FIGS. 6 and 7)

The second embodiment of the invention is a modification of the first embodiment, with the addition of a recirculated exhaust injection nozzle between the first and second compartments I and II and another nozzle between the first and supplementary air compartments I and III. Those injection nozzles give curtains of inert exhaust gases to prevent mutual interference of the jets from those compartments and to attain low NOx production as desired.

A pulverized coal line 41 is connected at the downstream end to a pulverized coal distributor 42, and an outlet of the distributor 42 for delivering the fuel mixture with a large proportion of pulverized coal is communicated through line 43 with a passageway 44 for the mixture of primary air and pulverized coal. At the downstream end of the passageway 44 is installed a nozzle 45 for pulverized coal injection. Another outlet of the distributor 42 for feeding the fuel mixture containing a less proportion of pulverized coal is communicated through line 46 with a primary air-pulverized coal mixture passageway 47. A pulverized coal injection nozzle 48 is installed at the downstream end of the passageway 47. A secondary air fan not shown connects with a secondary air pipe 49, which in turn connects with secondary air passageways 52, 53 surrounding the primary air-pulverized coal mixture passageways 44, 47 and holding at the downstream ends secondary air injection nozzles 50, 51, respectively. The pipe 49 also communicates with a supplementary air passageway 55 which carries a supplementary air nozzle 54.

The pulverized coal injection nozzle 45, primary air-pulverized coal mixture passageway 44, secondary air passageway 52, and secondary air injection nozzle 50 are combined to form a first pulverized coal injection compartment I. Similarly, the pulverized coal injection nozzle 48, primary air-pulverized coal mixture passageway 47, secondary air passageway 53, and secondary air injection nozzle 51 combinedly form a second pulverized coal injection compartment II. The supplementary air passageway 55 and injection nozzle 54 jointly constitute a supplementary air compartment III. Further, recirculated exhaust injection nozzles 56 are disposed, one for each, in spaces provided between the first and second pulverized coal injection compartments I and II and between the first compartment I and the supplementary air compartment III. Those injection nozzles 56 are communicated through passageways 57 with a recirculated exhaust pipe 58.

With the arrangement of the second embodiment, part of the combustion exhaust gas stream is branched out for recirculation from a proper point of the exhaust duct of the furnace. The recirculated exhaust gases are led through the pipe 58 and passageways 57 and then injected by the injection nozzles 56 into the furnace.

The inert exhaust gases issuing from the injection nozzles 56 form curtains to prevent the mutual interference of the fuel jets from the first and second pulverized coal injection compartments and also to keep the jets of pulverized coal and supplementary air from interfering with each other. This permits the jets of fuel from the first and second pulverized coal injection compartments, directed into the furnace, to maintain the initial air concentrations b and c in FIG. 3 over fairly long distances, thus achieving the reduction in NOx production to a desired low level.

THIRD EMBODIMENT (Refer to FIG. 8)

The third embodiment comprises two or more pulverized fuel burners stacked together, each burner consisting of the first compartment I, second compartment II, and supplementary air compartment III of the constructions already described. With the boundary between the burners in each pair as the base line of symmetry, the burners are arranged so that either of them is the mirror image of the other.

A pulverized coal line 61 is connected at the downstream end to a pulverized coal distributor 62, and an outlet of the distributor 62 for delivering the fuel mixture containing a large proportion of pulverized coal is communicated through line 63 with a passageway 64 for the mixture of primary air and pulverized coal. At the downstream end of the passageway 64 is installed a nozzle 65 for pulverized coal injection. Another outlet of the distributor 62 for feeding the fuel mixture having a less proportion of pulverized coal is communicated through line 66 with a primary air-pulverized coal mixture passageway 67. A pulverized coal injection nozzle 68 is installed at the downstream end of the mixture passageway 67. A secondary air fan not shown connects with a secondary air pipe 69, which in turn connects with secondary air passageways 72, 73 surrounding the primary air-pulverized coal mixture passageways 64, 67 and holding at the downstream ends secondary air injection nozzles 70, 71, respectively. The pipe 69 also communicates with a supplementary air passageway 75 which supports a supplementary air nozzle 74.

The pulverized coal injection nozzle 65, primary air-pulverized coal mixture passageway 64, secondary air passageway 72, and secondary air injection nozzle 70 are combined to form a first pulverized fuel injection compartment I. Likewise, the pulverized coal injection nozzle 68, primary air-pulverized coal mixture passageway 67, secondary air passageway 73, and secondary air injection nozzle 71 combinedly form a second pulverized fuel injection compartment II. The supplementary air passageway 75 and injection nozzle 74 jointly constitute a supplementary air compartment III. These three compartments constitute the first pulverized coal burner A. They are arranged in a stack of the second and first injection compartments II and I and the supplementary air compartment III, in the descending order.

As the mirror image of the first pulverized coal burner A, the second burner B is located under the first. The downstream end of a pulverized coal line 81 is connected to a pulverized coal distributor 82, and an outlet of the distributor 82 for feeding the fuel mixture having a large proportion of pulverized coal is communicated through line 83 with a passageway 84 for the mixture of primary air and pulverized coal. At the downstream end of the passageway 84 is installed a nozzle 85 for pulverized coal injection. Another outlet of the distributor 82 for feeding the fuel mixture with a less proportion of pulverized coal is communicated through line 86 with a primary air-pulverized coal mixture passageway 87, and a pulverized coal injection nozzle 88 is installed at the downstream end of the mixture passageway 87. The secondary air pipe 69 connects with secondary air passageways 92, 93 surrounding the primary air-pulverized coal mixture passageways 84, 87 and holding at the downstream ends secondary air injection nozzles 90, 91, respectively, and the pipe 69 also communicates with a supplementary air passageway 95 which supports a supplementary air nozzle 94.

Like the counterparts of the first pulverized coal burner, the pulverized coal injection nozzle 85, primary air-pulverized coal mixture passageway 84, secondary air passageway 92, and secondary air injection nozzle 90 are combined to form a first pulverized coal injection compartment I, the pulverized coal injection nozzle 88, primary air-pulverized coal mixture passageway 87, secondary air passageway 93, and secondary air injection nozzle 91 combinedly form a second pulverized coal injection compartment II, and the supplementary air passageway 95 and injection nozzle 94 form a supplementary air compartment III.

The second pulverized coal burner B is located adjacent to and immediately below the first burner A. In order that the compartments of the second burner may be the mirror image of those of the first, with the boundary between the two burners as the base line of symmetry, the supplementary air compartment III and the second and first pulverized coal compartments II and I of the second burner are integrally built in the descending order.

In the third embodiment the supplementary air compartments of the two adjacent pulverized coal burners are immediately stacked together as above described, and therefore only the jets of supplementary air interfere with each other. The jets of pulverized coal from the first and second injection compartments maintain the initial air concentrations b and c as shown in FIG. 3 over fairly long distances after the issuance toward the furnace, and hence the NOx production can be materially reduced.

Figure 9:
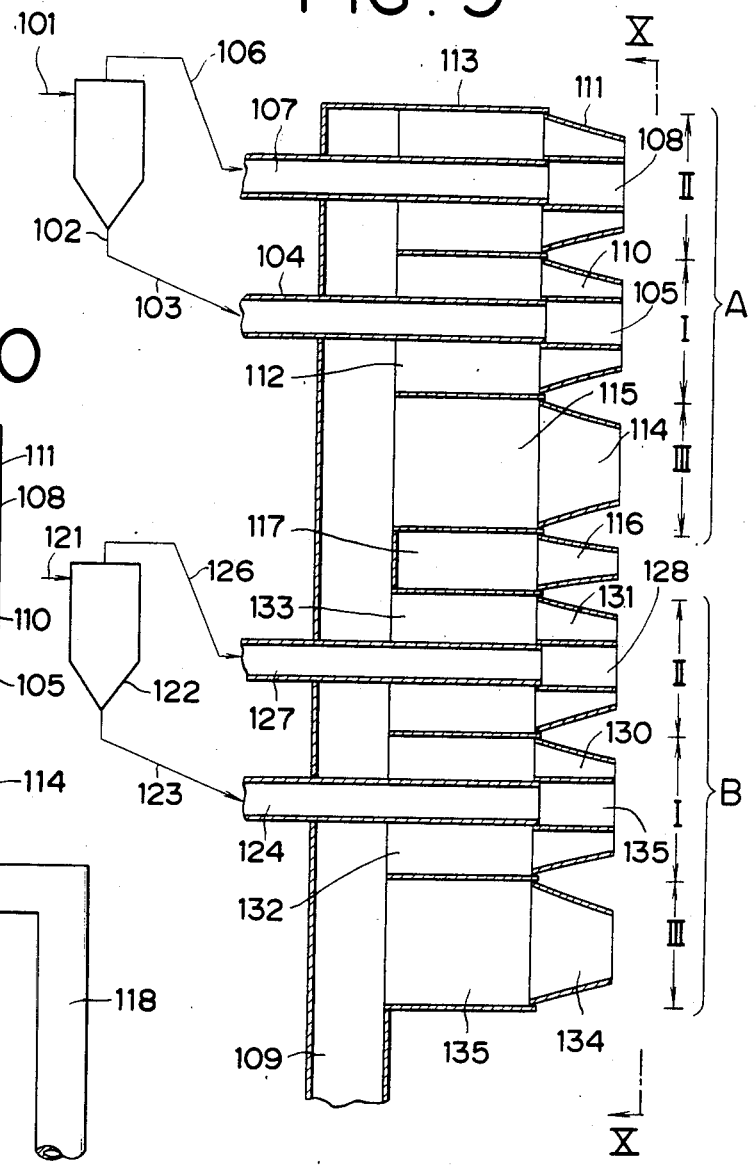
FIG. 9 is a partly sectional schematic view of a fourth embodiment of the invention.
Figure 10:
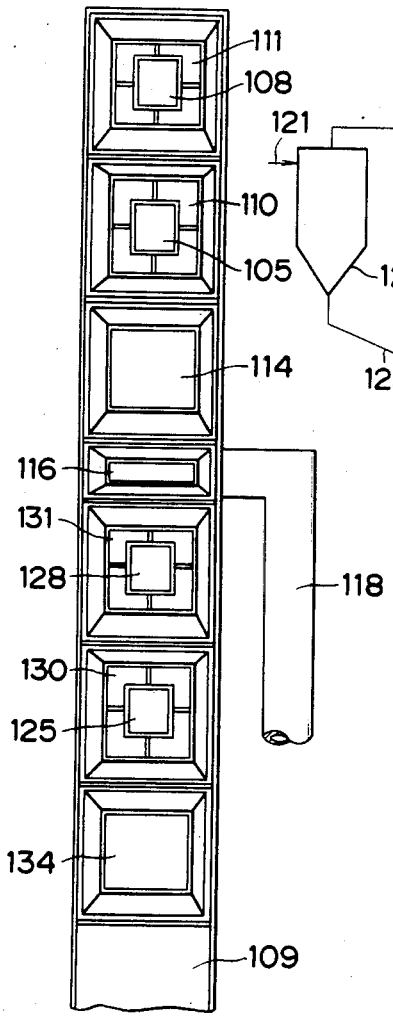
FIG. 10 is a front view taken on the line X—X of FIG. 9.

FOURTH EMBODIMENT (Refer to FIGS. 9 and 10)

The fourth embodiment incorporates a nozzle for issuing an inert fluid between pulverized fuel burners like those of the third embodiment, so as to prevent the mutual interference of the fuel jets from the two burners and thereby control the NOx formation.

The downstream end of a pulverized coal line 101 is connected to a pulverized coal distributor 102, and an outlet of the distributor 102 for feeding the fuel mixture having a large proportion of pulverized coal is communicated through line 103 with a passageway 104 for the mixture of primary air and pulverized coal. At the downstream end of the passageway 104 is installed a pulverized coal injection nozzle 105. Another outlet of the distributor 102 for feeding the fuel mixture having a less proportion of pulverized coal is communicated through line 106 with a primary air-pulverized coal mixture passageway 107, and a pulverized coal injection nozzle 108 is installed at the downstream end of the mixture passageway 107. A secondary air fan not shown connects with a secondary air pipe 109, which in turn connects with secondary air passageways 112, 113 surrounding the primary air-pulverized coal mixture passageways 104, 107 and holding at the downstream ends secondary air injection nozzles 110, 111, respectively. The pipe 109 also communicates with a supplementary air passageway 115 which supports a supplementary air nozzle 114.

The pulverized coal injection nozzle 105, primary air-pulverized coal mixture passageway 104, secondary air passageway 112, and secondary air injection nozzle 110 are combined to form a first pulverized coal injection compartment I. Similarly, the pulverized coal injection nozzle 108, primary air-pulverized coal mixture passageway 107, secondary air passage way 113, and secondary air injection nozzle 111 combinedly constitute a second pulverized coal injection compartment II. Further, the supplementary air passageway 115 and supplementary air injection nozzle 114 combinedly constitute a supplementary air compartment III. These three compartments form a first pulverized coal burner A.

On the other hand, the downstream end of a pulverized coal line 121 is connected to a pulverized coal distributor 122, and an outlet of the distributor 122 for feeding the fuel mixture containing a large proportion of pulverized coal is communicated through line 123 with a passageway 124 for the mixture of primary air and pulverized coal. At the downstream end of the passageway 124 is installed a pulverized coal injection nozzle 125. Another outlet of the distributor 122 for feeding the fuel mixture with a less proportion of pulverized coal is communicated through line 126 with a primary air-pulverized coal mixture passageway 127, and a pulverized coal injection nozzle 128 is installed at the downstream end of the mixture passageway 127. The secondary air pipe 109 connects with secondary air passageways 132, 133 which surround the primary air-pulverized coal mixture passageways 124, 127 and hold at the downstream ends secondary air injection nozzles 130, 131, respectively, and the pipe 109 also communicates with a supplementary air passageway 135 which supports a supplementary air nozzle 134.

The pulverized coal injection nozzle 125, primary air-pulverized coal mixture passageway 124, secondary air passageway 132, and secondary air injection nozzle 130 are combined to form a first pulverized coal injection compartment I. The pulverized coal injection nozzle 128, primary air-pulverized coal mixture passageway 127, secondary air passageway 133, and secondary air injection nozzle 131 combinedly constitute a second pulverized coal injection compartment II. The supplementary air passageway 135 and injection nozzle 134 form a supplementary air compartment III. These three compartments constitute a second pulverized coal burner B.

Between the first and second pulverized coal burners A and B is disposed a recirculated exhaust injection nozzle 116, which communicates with a recirculated exhaust pipe 118 via a recirculated exhaust passageway 117.

Part of the exhaust gas stream leaving a furnace is branched out from a proper point of the exhaust duct for recirculation, and passes through the recirculated exhaust pipe 118 and passageway 117 and then is injected into the furnace by the injection nozzle 116. The inert spent gases issued from the nozzle 116 form a curtain to prevent mutual interference of the air jets from the supplementary air compartments III and the fuel jets from the second pulverized coal injection compartments II of the first and second pulverized coal burners.

As a consequence, the jets of pulverized coal from the second pulverized coal injection compartments II of the both burners maintain the initial air concentrations b and c in FIG. 3 for fairly long periods of time after the injection into the furnace.

What is claimed is:

1. An apparatus for delivering a single pulverized fuel containing nitrogen for burning said single fuel in a furnace with reduced formation of nitrogen oxides having a burner with an end face terminating in a combustion zone; the improvement which comprises said burner having mixing means for mixing said pulverized fuel with primary air to form a primary air-fuel mixture;

lean mixture means including a first primary air-fuel mixture injection tube and a first secondary air injection tube adjacent thereto for combining said primary air-fuel mixture with secondary air in amounts less than the theoretical amount of combined air required for the combustion of said pulverized fuel to combust to form a flame;

rich mixture means forming a second primary air-fuel mixture injection tube and a second secondary air tube adjacent thereto for combining said primary air-fuel mixture with secondary air in amounts generally equal to the theoretical amount of air required for the combustion of said pulverized fuel to combust and add to said flame;

inert fluid means including an inert fluid injection tube between said first and second secondary air injection tubes for injection of an inert fluid between said two air-fuel mixtures;

supplemental air means forming a third supplementary air injection tube for injecting supplementary air into the furnace to form a unified flame with the said flame from said other injection tubes, said supplemental air means being separate from said other injection tubes;

wherein said lean mixture means and said rich mixture means and said supplemental air means and said inert fluid means are proximate each other on said burner to form a unified flame.

2. An apparatus according to claim 1 wherein said lean mixture means, rich mixture means, supplemental air means and inert fluid means combinedly constitute a pulverized fuel burner, and at least two such burners are arranged adjacent to each other so that each burner is a mirror image of the other and the injection tubes of said burners are located symmetrically with respect to a boundary between the burners as the base line of symmetry.

3. An apparatus according to claim 1 wherein the supplemental air means is adjacent said lean mixture, rich mixture and inert fluid means.

4. A method of delivering a single pulverized fuel containing nitrogen for burning said single fuel in a furnace with reduced formation of nitrogen oxides, which includes the steps of:

forming a first air-fuel mixture by combining primary air mixed with said pulverized fuel and secondary air in amounts less than the theoretical amount of combined air required for the combustion of said pulverized fuel and expelling said first air-fuel mixture from a first pulverized fuel injection tube to combust and form a flame;

forming a second air-fuel mixture by combining primary air mixed with said pulverized fuel and secondary air in amounts generally equal to the theoretical amount of air required for the combustion of said pulverized fuel and expelling said second mixture from a second pulverized fuel injection to combust and add to said flame;

injecting supplementary air into the furnace by first and second supplementary air injection tubes respectively proximate to said first and second injection tubes to form a unified flame with said flame and injecting an inert fluid to separate said first and second air-fuel mixtures by expelling said inert fluid from an inert fluid injection tube positioned between and adjacent said first and second supplemental air injection tubes.

5. A method according to claim 4, wherein said lean mixture means, richer mixture means, supplemental air means and inert fluid means combinedly constitute a pulverized fuel burner, and at least two such burners are arranged adjacent to each other with a boundary therebetween so that either of which is a mirror image of the other and the injection tubes of said burners are located symmetrically with respect to said boundary between the burners as the base line of symmetry.

6. The method according to claim 4 wherein the first and second supplementary air tubes are adjacent said first and second pulverized fuel and said inert fluid injection tubes.

* * * * *